US007434533B2

(12) United States Patent
Erskine et al.

(10) Patent No.: US 7,434,533 B2
(45) Date of Patent: Oct. 14, 2008

(54) GASKET FOR SUPPORTING AND SEALING A CURVED OBJECT

(75) Inventors: Edward J. Erskine, Benson, NY (US); David R. Irwin, Clifton Park, NY (US)

(73) Assignee: Taylor Made Group, Inc., Gloversville, NY (US)

( * ) Notice: Subject to any disclaimer, the term of this patent is extended or adjusted under 35 U.S.C. 154(b) by 919 days.

(21) Appl. No.: 10/882,624

(22) Filed: Jul. 2, 2004

(65) Prior Publication Data

US 2006/0000403 A1 Jan. 5, 2006

(51) Int. Cl.
*B60J 10/00* (2006.01)

(52) U.S. Cl. ..... 114/361; 296/93; 277/640; 277/644; 277/649

(58) Field of Classification Search ..... 114/343, 114/361; 296/93; 277/640, 644, 649
See application file for complete search history.

(56) References Cited

U.S. PATENT DOCUMENTS 3,151,674 A * 10/1964 Heller et al. ..... 165/158
4,815,410 A 3/1989 Muhlberger
4,903,629 A * 2/1990 Maudlin et al. ..... 114/361
6,244,601 B1 * 6/2001 Buchholz et al. ..... 277/637
6,453,841 B1 9/2002 Shearer et al.
6,527,278 B1 * 3/2003 Norris ..... 277/630
2003/0090122 A1 * 5/2003 Meizlish ..... 296/93

* cited by examiner

*Primary Examiner*—Sherman Basinger
(74) *Attorney, Agent, or Firm*—Nixon & Vanderhye P.C.

(57) ABSTRACT

A self-sealing gasket is suitable for sealing a curved object to a surface. The gasket includes a pair of side rails and a support panel between the side rails. Respective top portions of the side rails extend above the support panel to define an object receiving channel on an upper side of the gasket. Respective bottom portions of the side rails extend below the support panel to define a deflection cavity on a lower side of the gasket. The gasket is formed of a flexible material such that when the curved object is received in the object receiving channel and the curved object and gasket are fixed to the surface, the top portions of the side rails deflect inward to seal the curved object. By virtue of material deflection, a dense material may be used for the gasket while maintaining flexibility.

19 Claims, 1 Drawing Sheet

GASKET FOR SUPPORTING AND SEALING A CURVED OBJECT

CROSS-REFERENCES TO RELATED APPLICATIONS (Not Applicable)

STATEMENT REGARDING FEDERALLY SPONSORED RESEARCH OR DEVELOPMENT (Not Applicable)

BACKGROUND OF THE INVENTION

It is desirable to fix a curved windshield to a boat hull in a boat assembly process to provide better aerodynamic performance and improve the appearance of the final product. In order to accommodate a curved windshield, the windshield mounting angle must be variable during installation, thus requiring a specially configured bottom trim element that can adequately support the windshield while being positionable at different angles for securement to the boat.

Suitable bottom trim elements are described in U.S. Pat. No. 4,815,410 and U.S. Pat. No. 6,453,841, the contents of which are hereby incorporated by reference. These bottom trim elements generally include a curved bottom portion that can be secured to the boat hull at varying angles. In installation, it is important to properly seal the connected portions between the bottom trim elements and the boat hull.

To facilitate installation, various structural arrangements have been proposed such as sponge gaskets or caulk in order to seal the bottom trim element while accommodating tolerances and stabilizing the part during installation. Caulk, however, is messy and time-consuming to install. The material also frequently gets distorted during the boat assembly process. Moreover, final buffing of the product can smear the caulk and deteriorate the final product's appearance.

Sponge rubber gaskets may be faster to install, but the material does not hold up well to a finishing buffer, the environment or routine wear and tear. Dense rubber provides a better appearance and stands up well to assembly finishing processes and the environment, but dense rubber material is not easily compressed and thus would not seal without very closely spaced windshield mounting fasteners.

Still further, in a typical windshield installation process, holes are pre-drilled in the boat hull through which fasteners secure the windshield bottom trim elements. Prior to fixing the windshield in place, the hull holes are caulked in an effort to ensure that the seal is maintained after the windshield is screwed down and thereby prevent water from migrating below deck. This procedure of course adds time to the installation process.

BRIEF SUMMARY OF THE INVENTION

It would thus be desirable to provide a gasket to facilitate windshield mounting that benefits from the structural characteristics of a dense rubber gasket, but is also flexible so as to properly seal the windshield without needing the many fasteners required with the conventional dense rubber gasket. It would also be desirable to reduce installation time by eliminating the need to caulk pre-drilled holes prior to installation.

The gasket is designed with a receiving channel on an upper side thereof for receiving the bottom trim element or the like. A bottom of the gasket includes a deflection cavity that enables the support panel to deflect when the bottom trim element is set in the receiving channel and the assembly is fixed to a surface. When the gasket deflects by virtue of the bottom trim element being fixed to a surface, top portions of the receiving channel are deflected inwardly to thus provide a self-sealing assembly.

In an exemplary embodiment of the invention, a gasket for sealing a curved object against a surface includes a pair of side rails and a support panel between the side rails. Respective top portions of the side rails extend above the support panel to define an object receiving channel on an upper side of the gasket, and respective bottom portions of the side rails extend below the support panel to define a deflection cavity on a lower side of the gasket. The gasket is formed of a flexible material such that when the curved object is received in the object receiving channel and the curved object and gasket are fixed to the surface, the top portions of the side rails deflect inward to seal the curved object.

An exterior surface of each of the side rails is preferably angled inwardly from the bottom portions to the top portions such that the bottom portions extend wider than the top portions. Additionally, an interior surface of each of the side walls in the deflection cavity is preferably angled inwardly from the bottom portions to the support panel. An adhesive or adhesive tape may be applied to the support panel in the object receiving channel. The gasket is preferably formed of an extrudable material or rubber material such as ethylene copolymer (EPDM), with a Shore A hardness between 50-70, preferably about 60.

In another exemplary embodiment of the invention, a gasket for sealing a curved object includes a pair of side rails and a support panel between the side rails, where respective top portions of the side rails extend above the support panel to define an object receiving channel on an upper side of the gasket. The support panel is self-sealing relative to the curved object via the top portions of the side rail when the curved object and the gasket are fixed to the surface. Preferably, the support panel is configured to effect self-sealing via deflection when the curved object is set in the object receiving channel and the curved object and gasket are fixed to the surface. Respective bottom portions of the side rails extend below the support panel to define a deflection cavity on a lower side of the gasket, and the support panel is deflected toward the deflection cavity to effect self-sealing when the curved object is set in the object receiving channel and the curved object and gasket are fixed to the surface.

In yet another exemplary embodiment of the invention, a method of sealing a curved object to a surface includes the steps of supporting the curved object with a gasket receiving end facing up; providing the gasket of the invention; fitting the object receiving channel over the gasket receiving end of the curved object; and inverting the curved object with the gasket attached and fixing the curved object and the gasket to the flat surface such that the top portions of the side rails deflect inward to seal the curved object. The fixing step may include inserting a fixing member through the curved object, through the gasket, and into or through the surface. Preferably, the gasket further includes an adhesive applied to the support panel in the object receiving channel. In this context, the fitting step further includes securing the object receiving channel over the gasket receiving end of the curved object via the adhesive.

In still another exemplary embodiment of the invention, a gasket for sealing a curved object to a surface includes a pair of side rails and a support panel between the side rails. The support panel defines an object receiving channel on an upper side of the gasket. The object receiving channel is self-sealing relative to the curved object via deflection of the gasket when the curved object and the gasket are fixed to the surface.

BRIEF DESCRIPTION OF THE DRAWINGS

These and other aspects and advantages of the present invention will be described in detail with reference to the accompanying drawings, in which.

DETAILED DESCRIPTION OF THE INVENTION

Figure 1:
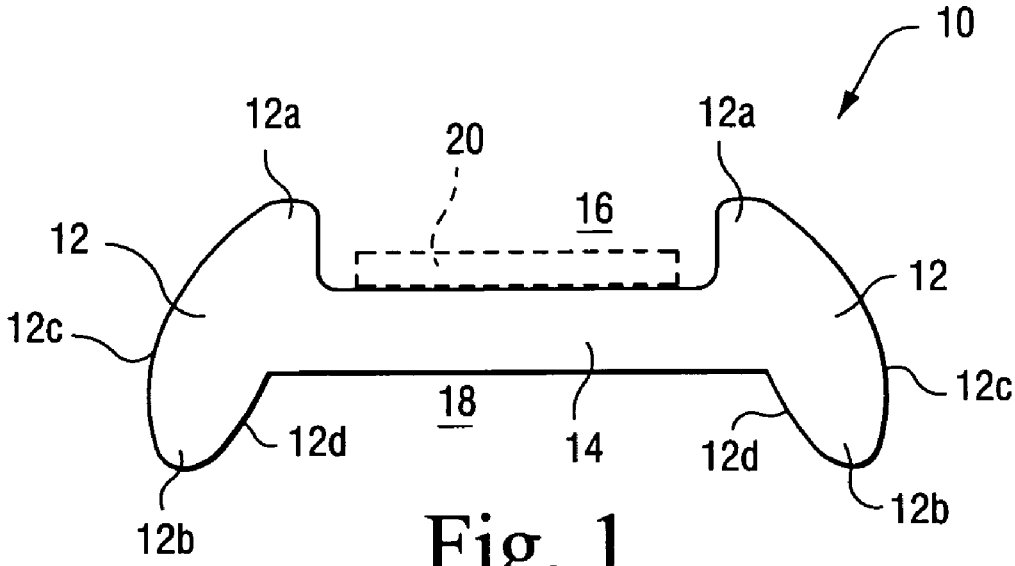
FIG. 1 is an end view of the gasket according to the present invention.

The gasket 10 of the present invention is shown in FIG. 1. The gasket 10 generally includes a pair of side rails 12 and a support panel 14 between the side rails 12. As shown, respective top portions 12*a* of the side rails 12 extend above the support panel 14 and define an object receiving channel 16 on an upper side of the gasket 10. Respective bottom portions 12*b* of the side rails 12 extend below the support panel 14 and define a deflection cavity 18 on a lower side of the gasket 10.

As shown, an exterior surface 12*c* of each of the side rails 12 is generally angled inwardly from the bottom portions 12*b* to the top portions 12*a*. An interior surface 12*d* of each of the side walls 12 in the deflection cavity 18 is angled inwardly from the bottom portions 12*b* to the support panel 14. As a consequence, the bottom portions 12*b* extend wider than the top portions 12*a*.

An adhesive, such as an adhesive tape 20, is preferably applied to the support panel 14 in the object receiving channel 16. A double-sided acrylic adhesive tape is preferable, although certainly other adhesive materials may be suitable.

The gasket 10 is preferably integrally formed via extrusion of a suitable material, which is preferably a dense rubber material that is tough enough to withstand exposure to a marine environment as well as the finishing processes of the boat assembly and routine wear and tear. Preferably, the gasket 10 is formed of ethylene copolymer (EPDM), with a Shore A hardness between 50-70, and most preferably about 60. Other suitable materials may include flexible PVC, other thermoplastic elastomers, or rubber composites.

In use, although the gasket material is formed of what would generally be considered a dense material, the gasket is readily flexible during installation via deflection of the support panel 14 into the deflection cavity 18 and the wider position of the side rail bottom portions 12*b*. That is, with reference to FIG. 2, when a bottom trim element 30 or other curved object is received in the object receiving channel 16 and the bottom trim element 30 is fixed to a surface 32, the top portions 12*a* of the side rails 12 deflect inward due to a moment caused by the wider side rail bottom portions 12*b* to engage and seal the curved object 30 as the support panel 14 is deflected into the deflection cavity 18. Thus, the object receiving panel 16 is self-sealing relative to the curved object 30 via the top portions 12*a* of the side rails 12 when the object 30 is fixed to the surface 32. The self-sealing is effected via deflection when the curved object 30 is set in the object receiving channel 16 and the curved object 30 and gasket 10 are fixed to the surface 32. When assembled, the side rail top portions 12*a* also serve to hide the adhesive tape 20.

Figure 2:
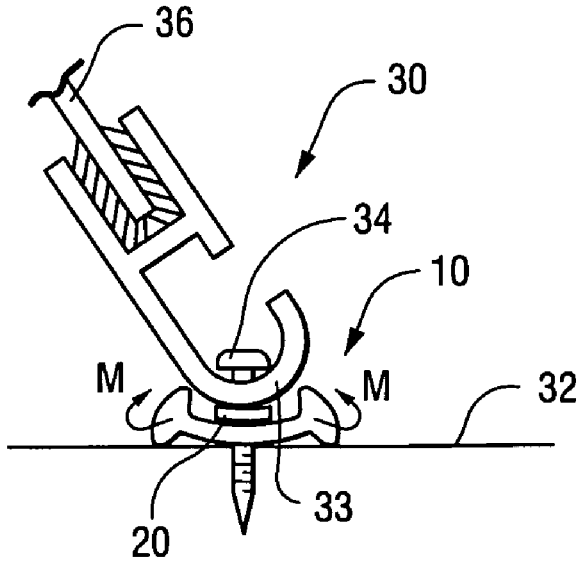
FIG. 2 illustrates an exemplary application of the gasket depicted in FIG. 1, supporting a bottom trim element of a boat windshield.

With continued reference to FIG. 2, a method of securing a curved object 30 to a surface 32 will be described in conjunction with the installation of a windshield bottom trim element to a boat hull, although this application is exemplary, and the invention is not meant to be limited to the described example. In addition, the surface may be a generally flat surface, a curved surface, or otherwise uneven surface as long as the gasket 10 can be effectively sealed against it.

The curved object 30 is first supported with a gasket receiving end 33 (curved bottom end of the bottom trim element) facing up. The object receiving channel 16 of the gasket 10 is fit over the gasket receiving end 33 of the curved object 30. The adhesive 20 serves to temporarily secure the gasket 10 in place. The curved object 30 and attached gasket 10 are then inverted, and the curved object 30 and the gasket 10 are fixed to the flat surface 32 via a fixing member 34 such as a screw. As the fixing member 34 compresses the assembly (i.e., the bottom trim element 30 and the gasket 10), a moment is created around the side rails 12 (designated by arrows M in FIG. 2), and the top portions 12*a* of the side rails 12 deflect inward to engage the curved object 30. In the windshield bottom trim element example, a plurality of fixing members 34 are secured spaced along a length of the windshield 36 to attach the bottom trim element 30 and thus the windshield 36 on the boat hull 32.

The fixed gasket 10 also provides an effective seal with the surface 32 and seals around the fasteners 34. As a consequence, it is not necessary to caulk pre-drilled installation holes, thereby reducing manufacturing time.

By providing side rails that define an object receiving channel on an upper side of the gasket and a deflection cavity on a lower side of the gasket, a flexible self-sealing gasket can be provided using a sturdy dense material. The gasket is designed to flex as the windshield bottom trim is mounted, thereby pinching the windshield bottom trim and creating a seal without needing additional fasteners as required with conventional constructions. Moreover, compression of the gasket directly below the fixing member eliminates the need for caulk in the pre-drilled mounting fastener holes. The assembly is thus easily and inexpensively constructed while providing an effective seal.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

The invention claimed is:

1. A gasket for sealing a curved object to a surface, the gasket comprising a pair of side rails and a support panel between the side rails, wherein respective top portions of the side rails extend above the support panel to define an object receiving channel on an upper side of the gasket, wherein respective bottom portions of the side rails extend below the support panel to define a deflection cavity on a lower side of the gasket, wherein the gasket is formed of a flexible material and is structurally configured such that when the curved object is received in the object receiving channel and the curved object and gasket are fixed to the surface, the top portions of the side rails deflect inward to effect a sealing engagement with the curved object, and wherein the bottom portions of the side rails are sized and positioned relative to the support panel such that at least a portion of the deflection cavity adjacent the bottom portions of the sidewalls is maintained when the curved object is received in the object receiving channel and the curved object and gasket are fixed to the surface.

2. A gasket according to claim 1, wherein an exterior surface of each of the side rails is angled inwardly from the bottom portions to the top portions such that the bottom portions extend wider than the top portions.

3. A gasket according to claim 2, wherein an interior surface of each of the side rails in the deflection cavity is angled inwardly from the bottom portions to the support panel.

4. A gasket for sealing a curved object to a surface, the gasket comprising:

a pair of side rails;

a support panel between the side rails, wherein respective top portions of the side rails extend above the support panel to define an object receiving channel on an upper side of the gasket; and an adhesive applied to the support panel in the object receiving channel, wherein respective bottom portions of the side rails extend below the support panel to define a deflection cavity on a lower side of the gasket, and wherein the gasket is formed of a flexible material and is structurally configured such that when the curved object is received in the object receiving channel and the curved object and gasket are fixed to the surface, the top portions of the side rails deflect inward to effect a sealing engagement with the curved object.

5. A gasket according to claim 4, wherein the adhesive comprises an adhesive tape applied to the support panel in the object receiving channel.

6. A gasket according to claim 1, wherein the gasket is formed of a rubber material.

7. A gasket according to claim 6, wherein the gasket is formed of ethylene copolymer (EPDM).

8. A gasket according to claim 7, wherein the EPDM material has a Shore A hardness between 50-70.

9. A gasket according to claim 7, wherein the EPDM material has a Shore A hardness of about 60.

10. A gasket according to claim 1, wherein the gasket is formed of an extrudable material.

11. A gasket for sealing a curved object to a surface, the gasket comprising a pair of side rails and a support panel between the side rails, wherein respective top portions of the side rails extend above the support panel to define an object receiving channel on an upper side of the gasket, and wherein respective bottom portions of the side rails extend below the support panel to define a deflection cavity on a lower side of the gasket, the object receiving channel being self-sealing relative to the curved object to effect a sealing engagement with the curved object via the top portions of the side rails and the support panel is deflected toward the deflection cavity when the curved object is set in the object receiving channel and the curved object and the gasket are fixed to the surface, wherein the bottom portions of the side rails are sized and positioned relative to the support panel such that at least a portion of the deflection cavity adjacent the bottom portions of the sidewalls is maintained when the curved object is received in the object receiving channel and the curved object and gasket are fixed to the surface.

12. A gasket according to claim 11, wherein the support panel is configured to effect self-sealing via deflection when the curved object is set in the object receiving channel and the curved object and gasket are fixed to the surface.

13. A gasket for sealing a curved object to a surface, the gasket comprising a pair of side rails and a support panel between the side rails, wherein respective top portions of the side rails extend above the support panel to define an object receiving channel on an upper side of the gasket, the object receiving channel being self-sealing relative to the curved object to effect a sealing engagement with the curved object via the top portions of the side rails when the curved object and the gasket are fixed to the surface, the gasket further comprising an adhesive applied to the support panel in the object receiving channel.

14. A gasket according to claim 13, wherein the adhesive comprises an adhesive tape applied to the support panel in the object receiving channel.

15. A gasket according to claim 11, wherein the gasket is formed of a rubber material.

16. A gasket according to claim 15, wherein the gasket is formed of ethylene copolymer (EPDM).

17. A method of sealing a curved object to a surface, the method comprising:

supporting the curved object with a gasket receiving end facing up;

providing a gasket including a pair of side rails and a support panel between the side rails, wherein respective top portions of the side rails extend above the support panel to define an object receiving channel on an upper side of the gasket, and wherein respective bottom portions of the side rails extend below the support panel to define a deflection cavity on a lower side of the gasket;

fitting the object receiving channel over the gasket receiving end of the curved object; and inverting the curved object with the gasket attached and fixing the curved object and the gasket to the surface such that the top portions of the side rails deflect inward to seal the curved object.

18. A method according to claim 17, wherein the fixing step comprises inserting a fixing member through the curved object, through the gasket, and into or through the surface.

19. A method according to claim 17, wherein the gasket further comprises an adhesive applied to the support panel in the object receiving channel, and wherein the fitting step further comprises securing the gasket object receiving channel over the gasket receiving end of the curved object via the adhesive.

* * * * *